US010273585B2

(12) United States Patent
Crondahl et al.

(10) Patent No.: US 10,273,585 B2
(45) Date of Patent: Apr. 30, 2019

(54) CATHODIC PROTECTION FOR WOOD VENEER DRYERS AND METHOD FOR REDUCING CORROSION OF WOOD VENEER DRYERS

(71) Applicant: Westmill Industries Ltd., Aldergrove (CA)

(72) Inventors: Michael Crondahl, Mission (CA); Christian Gollmann, Eugene, OR (US)

(73) Assignee: Westmill Industries Ltd., Aldergrove (CA)

( * ) Notice: Subject to any disclaimer, the term of this patent is extended or adjusted under 35 U.S.C. 154(b) by 232 days.

(21) Appl. No.: 14/736,099

(22) Filed: Jun. 10, 2015

(65) Prior Publication Data

US 2016/0362797 A1 Dec. 15, 2016

(51) Int. Cl.
*C23F 13/06* (2006.01)
*C23F 13/04* (2006.01)
(Continued)

(52) U.S. Cl.
CPC ..... *C23F 13/06* (2013.01); *C23F 13/04* (2013.01); *C23F 13/16* (2013.01); *F26B 5/16* (2013.01);
(Continued)

(58) Field of Classification Search
CPC ..... C23F 13/02; C23F 13/04; C23F 13/08; C23F 13/10; C23F 13/12–13/14;
(Continued)

(56) References Cited

U.S. PATENT DOCUMENTS 1,739,766 A 12/1929 Morris
2,706,342 A * 4/1955 Willis ..... F26B 7/00 34/350
(Continued)

FOREIGN PATENT DOCUMENTS

DE 2217715 A * 4/1971 ..... C23F 13/04
DE 20 2012 010 945.6 1/2013
(Continued)

OTHER PUBLICATIONS

Beckley (Insulated Aluminum Panels for Dry Kiln Walls and Roofs, 1957, pp. 33-41, http://ir.library.oregonstate.edu/xmlui/bitstream/handle/1957/5887/Insulated_Aluminum_ocr.pdf).*
(Continued)

*Primary Examiner* — Alexander W Keeling
(74) *Attorney, Agent, or Firm* — Oyen Wiggs Green & Mutala LLP

(57) ABSTRACT

A cathodic protection system for use with a wood veneer dryer is provided. The system includes a DC power supply and an anode mounted inside the dryer in a position to be electrolytically coupled to metallic structures or surfaces inside the dryer when an electrolytic medium is present inside the dryer. The electrolytic medium comprises a high-humidity atmosphere. A method for reducing the corrosion of metallic structures or surfaces inside the dryer is further provided. The method comprises mounting an anode inside the dryer in a position to be electrolytically coupled to the metallic structures or surfaces inside the dryer when an electrolytic medium is present. Wood veneer is conveyed through the dryer and heated to a temperature sufficient to produce a high-humidity atmosphere inside the dryer. A controlled amount of current is supplied by the DC power supply to electrolytically couple the anode to the metallic structures or surfaces.

24 Claims, 4 Drawing Sheets

(51) Int. Cl.

| | |
|---|---|
| ***C23F 13/16*** | (2006.01) |
| ***F26B 21/00*** | (2006.01) |
| ***F26B 5/16*** | (2006.01) |
| *C23F 13/14* | (2006.01) |

(52) U.S. Cl.
CPC ..... *F26B 21/00* (2013.01); *C23F 13/14* (2013.01); *C23F 2213/30* (2013.01); *F26B 2200/12* (2013.01)

(58) Field of Classification Search
CPC ..... C23F 13/16; C23F 13/18; C23F 13/22; C23F 2213/10; C23F 2213/30; C23F 2213/31
See application file for complete search history.

(56) References Cited

U.S. PATENT DOCUMENTS

| | | | | |
|---|---|---|---|---|
| 2,944,957 | A | 7/1960 | Keidel | |
| 3,009,865 | A | 11/1961 | Mueller et al. | |
| 3,072,128 | A | 1/1963 | James | |
| 3,216,916 | A | 11/1965 | Locke | |
| 3,350,288 | A | 10/1967 | Almar-Naess | |
| 3,379,629 | A | 4/1968 | Banks et al. | |
| 3,585,734 | A | 6/1971 | Barton et al. | |
| 4,621,669 | A | 11/1986 | Kivimaa | |
| 5,340,455 | A * | 8/1994 | Kroon | C23F 13/06 204/196.3 |
| 5,954,938 | A * | 9/1999 | Takahashi | C23F 13/04 204/196.11 |
| 8,372,251 | B2 | 2/2013 | Goller et al. | |
| 2005/0236279 | A1 * | 10/2005 | Vaelitalo | C23F 13/02 205/734 |

FOREIGN PATENT DOCUMENTS

| | | | | |
|---|---|---|---|---|
| EP | 1640478 | A2 * | 3/2006 | C23F 13/04 |
| JP | 2010-43307 | | 2/2010 | |

OTHER PUBLICATIONS

Derwent abstract for DE 2,217,715.*
White et al ("Ice Houses and Ice Supply", National Lumber Manufacturers Association, 1916, pp. "Ten"-"Eleven") (Year: 1916).*
"Moisture" by Oxford Dictionary. (Year: 2018).*

* cited by examiner

CATHODIC PROTECTION FOR WOOD VENEER DRYERS AND METHOD FOR REDUCING CORROSION OF WOOD VENEER DRYERS

TECHNICAL FIELD

The present invention relates generally to the protection of metallic structures or surfaces prone to corrosion and, in particular, this invention relates to cathodic protection for wood veneer dryers and methods for reducing corrosion of wood veneer dyers.

BACKGROUND OF INVENTION

Single and multiple deck conveyor dryers for reducing the moisture content of sheet materials, including green (or wet) wood veneer, wherein the material being dried is conveyed through a stationary drying chamber while heated gases are circulated through the drying chamber, are well-known in the art. Evaporation of moisture, inorganic compounds, and/or organic compounds (i.e. volatile organic compounds (V.O.C.'s)) from the material being dried causes a build-up of steam within the dryer, which may condense with carbon dioxide to form a corrosive liquid on the walls of the veneer dryer and on other equipment. Many metals corrode due to exposure to moisture and corrosion of metallic structures and surfaces of the dryer has been a major problem in the veneer drying art.

It is desirable to control the corrosion of metallic structures and surfaces of a wood veneer dryer to extend the lifetime of the dryer. To reduce corrosion, metallic structures and surfaces inside of veneer dryers may be made from or coated with corrosion-resistant alloys, such as stainless steel. However, corrosion-resistant alloys are typically expensive. Furthermore, moisture is not precluded from migrating into dryer panel cracks or missed welds not treated with the corrosion-resistant alloy. There is accordingly a need in the art for a wood veneer dryer wherein the metallic structures and surfaces inside the dryer susceptible to corrosion are protected.

Cathodic protection is known in the art to control the corrosion of a metal by making it the cathode of an electrolytic cell. The metal to be protected is connected to a more easily corroded "sacrificial" metal that acts as the anode. The sacrificial metal then corrodes instead of the protected metal. The driving force for the cathodic protection current is the difference in electrode potential between the anode and the cathode.

A cathodic protection system is essentially a closed electric circuit that requires an anode and cathode to be immersed in an electrolyte; hence, cathodic protection is not used to prevent atmospheric corrosion. Typically, the structure to be protected is immersed in a body of fresh or salt water or is buried in moisture-rich soil.

In practice, the main use of cathodic protection is to protect steel structures immersed in a body of water or buried in moisture-rich soil (for example, the exterior surfaces of pipelines, ships' hulls, jetties, foundation piling, steel sheet piling, offshore platforms, and the interior surfaces of water-storage tanks and water-circulating systems).

Due to high maintenance and installation costs, cathodic protection is typically considered to be prohibitively expensive for use with relatively small scale structures, such as wood veneer dryers. Use is further limited by the need for structures to be immersed in a body of water or buried in moisture-rich soil.

The foregoing examples of the related art and limitations related thereto are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

One aspect of the present invention provides a cathodic protection system for use with a wood veneer dryer. The cathodic protection system includes a DC power supply and an anode mounted inside the veneer dryer in a position to be electrolytically coupled to metallic structures or surfaces inside the veneer dryer when an electrolytic medium is present. The DC power supply has a positive pole electrically connected to the anode and a negative pole electrically connected to the metallic structures or surfaces inside the veneer dryer.

In some embodiments, the anode is more electronegative than the metallic structures or surfaces.

In some embodiments, the anode comprises one or more of high silicon iron, graphite, mixed metal oxides, lead alloys, platinum, zinc, aluminum, magnesium, cadmium, niobium, tantalum, titanium, ruthenium, ruthenium oxide, rhodium, and rhodium oxide, preferably niobium.

In some embodiments, the anode comprises a niobium ribbon.

In some other embodiments, the anode is coated with a material that is more electronegative than the metallic structures and surfaces.

In some embodiments, the material comprises one or more of high silicon iron, graphite, mixed metal oxides, lead alloys, platinum, zinc, aluminum, magnesium, cadmium, niobium, tantalum, titanium, ruthenium, ruthenium oxide, rhodium, and rhodium oxide, preferably niobium.

In some embodiments, the anode comprises a niobium-coated ribbon.

In some embodiments, the anode is wrapped in an air-permeable membrane.

In some embodiments, the air-permeable membrane comprises one or more of a mineral wool, glass fibers, ceramics, and clays, preferably mineral wool.

In some embodiments, the anode extends from an input end to an output end of the veneer dryer inside a drying chamber.

In some embodiments, the cathodic protection system further includes a computer system to monitor the conditions inside the veneer dryer and to adjust the amount of current supplied by the DC power supply based on the detected conditions.

In some embodiments, the DC power supply supplies an amount of current to the anode and metallic structures or surfaces inside the veneer dryer to shift the potential of the metallic structures or surfaces within the range of about (−) 0.700 V vs. silver/silver chloride (Ag/AgCl) to about (−) 1.200 V vs. silver/silver chloride (Ag/AgCl), preferably about (−) 0.800 V vs. silver/silver chloride (Ag/AgCl) or about (−) 0.950 V vs. silver/silver chloride (Ag/AgCl).

In some other embodiments, the DC power supply supplies an amount of current to the anode and metallic structures or surfaces inside the veneer dryer based on one or more of pH, temperature, electrolytic medium concentration, and electrolytic medium conductivity.

In some embodiments, the electrolytic medium comprises a high-humidity atmosphere inside the veneer dryer.

In some embodiments, the anode is mounted in a protective housing inside the veneer dryer.

Another aspect of the present invention provides a method for reducing the corrosion of metallic structures or surfaces inside a wood veneer dryer. The method includes mounting an anode inside a veneer dryer in a position to be electrolytically coupled to the metallic structures or surfaces inside the veneer dryer when an electrolytic medium is present inside the veneer dryer. A positive pole of a DC power supply is electrically connected to the anode and a negative pole of the DC power supply is electrically connected to the metallic structures and surfaces. Green wood veneer is conveyed through the veneer dryer and heated to a temperature sufficient to produce a high-humidity atmosphere inside the veneer dryer. A controlled amount of current is supplied by the DC power supply to electrolytically couple the anode to the metallic structures or surfaces.

In some embodiments, the conditions inside the veneer dryer are monitored and the amount of current supplied by the DC power supply is adjusted based on the detected conditions.

In some embodiments, the amount of current supplied shifts the potential of the metallic structures or surfaces within the range of about (−) 0.700 V vs. silver/silver chloride (Ag/AgCl) to about (−) 1.200 V vs. silver/silver chloride (Ag/AgCl), preferably about (−) 0.800 V vs. silver/silver chloride (Ag/AgCl) or about (−) 0.950 V vs. silver/silver chloride (Ag/AgCl).

In some other embodiments, the amount of current supplied is ascertainable based on one or more of pH, temperature, electrolytic medium concentration, and electrolytic medium conductivity.

In some embodiments, the anode is wrapped in an air-permeable membrane.

In some embodiments, the air-permeable membrane comprises one or more of a mineral wool, glass fibers, ceramics, and clays, preferably mineral wool.

In some embodiments, the anode is more electronegative than the metallic structures or surfaces.

In some embodiments, the anode comprises one or more of high silicon iron, graphite, mixed metal oxides, lead alloys, platinum, zinc, aluminum, magnesium, cadmium, niobium, tantalum, titanium, ruthenium, ruthenium oxide, rhodium, and rhodium oxide, preferably niobium.

In some embodiments, the anode comprises a niobium ribbon.

In some other embodiments, the anode is coated with a material that is more electronegative than the metallic structures and surfaces.

In some embodiments, the material comprises one or more of high silicon iron, graphite, mixed metal oxides, lead alloys, platinum, zinc, aluminum, magnesium, cadmium, niobium, tantalum, titanium, ruthenium, ruthenium oxide, rhodium, and rhodium oxide, preferably niobium.

In some embodiments, the anode comprises a niobium-coated ribbon.

In some embodiments, the anode extends from an input end of the veneer dryer to an output end of a drying chamber of the veneer dryer.

In some embodiments, the anode is mounted in a protective housing inside the veneer dryer.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed are to be considered illustrative of the invention rather than restrictive.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

In this specification, the term "cathodic protection" means controlling the corrosion of a metal structure or surface by making it the cathode of an electrolytic cell. The term "electrolytic cell" means a cell consisting of an electrolyte, its container, and two electrodes (i.e. an anode and a cathode), in which a redox reaction between the electrodes and the electrolyte occurs when an electrical current is applied. The term "anode" means an electrode or terminal by which current enters an electrolytic cell. The term "cathode" means an electrode or terminal by which current leaves an electrolytic cell. The term "electrolyte" means a medium capable of conducting current and in which the flow of current is accompanied by the movement of ions. The term "electrolytically coupled" means the coupling of a pair of electrodes in an electrolytic cell through an electrolyte thereby producing a redox reaction when an electrical current is applied to the cell. The term "corrosive medium" means any fluid that is corrosive to, or promotes corrosion of, a metallic structure or surface. The term "electrolytic medium" means any fluid capable of conducting current and in which the flow of current is accompanied by the movement of ions. The term "moisture" means a fluid, including but not limited to steam and/or condensed steam. The term "high-humidity atmosphere" means an atmosphere having a relatively high amount of moisture. The term "input end" in relation to the wood veneer dryer and components thereof means the end wherein wood veneer to be dried is introduced into the dryer, input end seal chamber, drying chamber, intermediary chamber, or cooling chamber. The term "output end" in relation to the wood veneer dryer and components thereof means the end opposite to the input end, i.e. the end wherefrom dried wood veneer exits the dryer, input end seal chamber, drying chamber, intermediary chamber, or cooling chamber. The term "about" means near the stated value (i.e. within +/−10% of the stated value).

Figure 1:
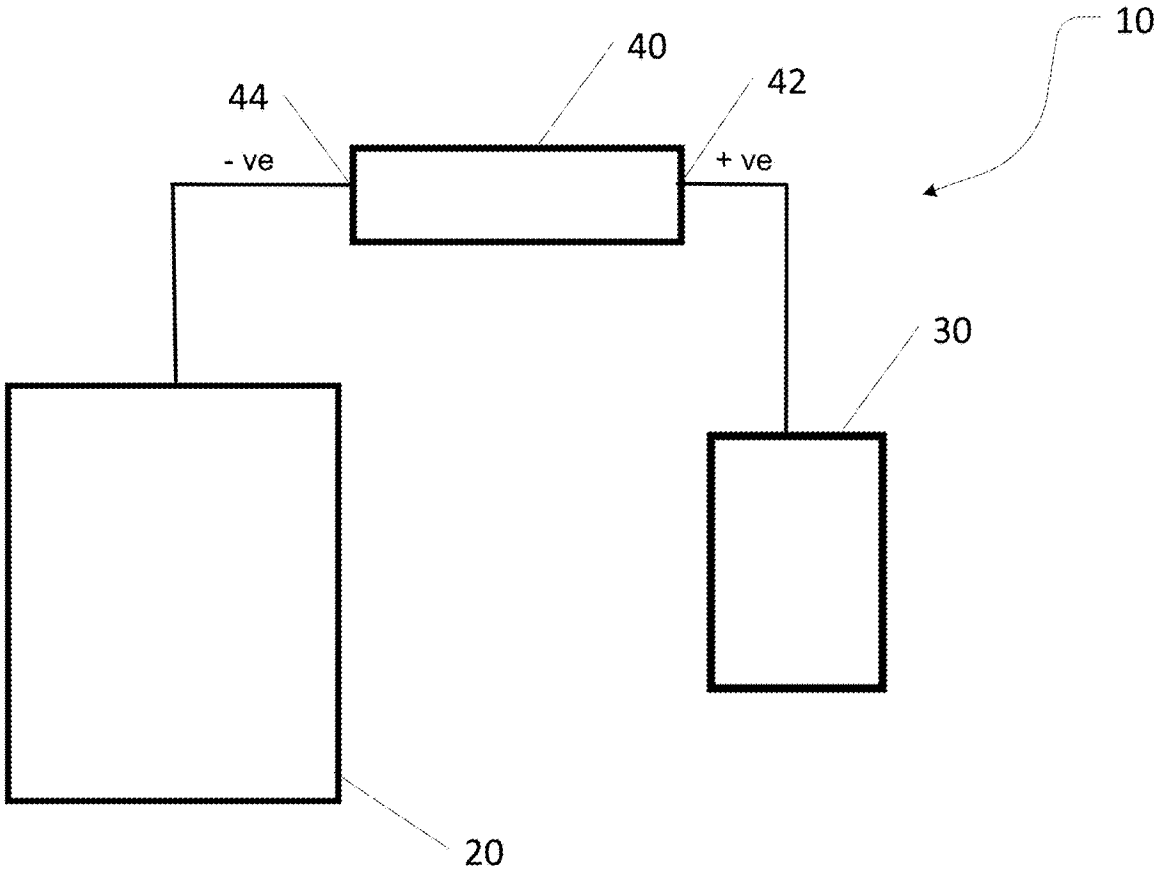
FIG. 1 is a schematic of a cathodic protection system according to an embodiment of the present invention.
Figure 2:
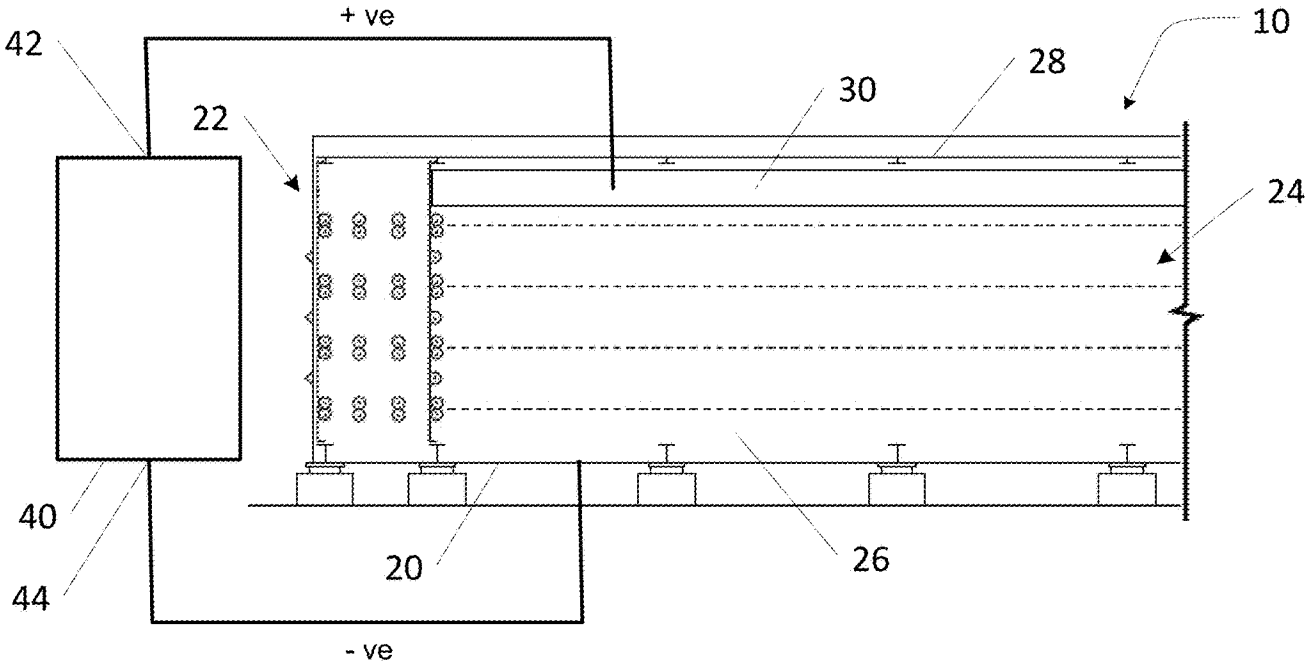
FIG. 2 is a partial cross-sectional side elevation view of the cathodic protection system of the embodiment show in FIG. 1.

A cathodic protection system 10, as shown in FIGS. 1 and 2, comprises a wood veneer dryer 20, an anode 30 mounted inside veneer dryer 20, and an external DC power supply 40 having a positive pole 42 electrically connected to anode 30 and a negative pole 44 electrically connected to veneer dryer 20. Veneer dryer 20 may be a conventional single or multiple deck conveyor dryer for reducing the moisture content of sheet materials, including green wood veneer, wherein the material being dried is conveyed from an input end 22 to an output end 24 of a stationary drying chamber 26 while heated gases are circulated through drying chamber 26.

As the wood veneer to be dried is heated, moisture and inorganic and/or organic compounds (such as V.O.C.'s) are released from the wood veneer producing a high-humidity atmosphere inside veneer dryer 20. The high-humidity atmosphere inside veneer dryer 20 serves as a corrosive medium and/or an electrolytic medium inside veneer dryer 20. The composition of the corrosive medium and/or the electrolytic medium inside veneer dryer 20 will vary depending on the species of wood dried and the conditions found inside veneer dryer 20 (i.e. temperature, pH, humidity, etc.).

Referring to FIG. 2, anode 30 is mounted inside veneer dryer 20 in a position to be electrolytically coupled to the metallic structures and/or surfaces inside veneer dryer 20 when an electrolyte is present. In some embodiments, anode 30 is mounted to a ceiling 28 of veneer dryer 20 and extends from input end 22 to output end 24 of drying chamber 26. Positive pole 42 of DC power supply 40 is electrically connected to anode 30 at one or more locations along the length of anode 30 to supply current to anode 30. For example, in some embodiments, positive pole 42 of DC power supply 40 may be electrically connected to anode 30 about every 4.5 to 6 m (15 to 20 feet) along the length of anode 30.

In some embodiments, anode 30 may be more electronegative than the metallic structures and surfaces inside veneer dryer 20. Based on the conditions found within veneer dryer 20 (for example, temperature and/or pH), anode 30 may comprise one or more of the following materials: high silicon iron, graphite, mixed metal oxides, lead alloys, platinum, zinc, aluminum, magnesium, cadmium, niobium, tantalum, titanium, ruthenium, ruthenium oxide, rhodium, and rhodium oxide, preferably niobium. In some other embodiments, anode 30 may be coated with a material that is more electronegative than the metallic structures and surfaces inside veneer dryer 20. Based on the conditions found within veneer dryer 20 (for example, temperature and/or pH), the coating may comprise one or more of the following materials: high silicon iron, graphite, mixed metal oxides, lead alloys, platinum, zinc, aluminum, magnesium, cadmium, niobium, tantalum, titanium, ruthenium, ruthenium oxide, rhodium, and rhodium oxide, preferably niobium. In some embodiments, anode 30 comprises a niobium-coated wire or a niobium-coated ribbon. In other embodiments, anode 30 comprises niobium or a niobium ribbon. Persons skilled in the art will recognize that anode 30 may be comprised of or coated with any material that exhibits any one or more of the following features: good electrical conduction; a low rate of corrosion; good mechanical properties; the ability to withstand the stresses which they may be subjected to during installation and in service; the ability to be readily fabricated into a variety of shapes; low cost; and/or the ability to withstand high current densities at its surface without forming resistive barrier oxide layers. Niobium, for example, can resist becoming passive (i.e. developing an oxidation layer) at high temperatures and within the voltage range required to operate catalytic protection system 10, while being capable of delivering constant watt density when a current is applied thereto in a closed circuit.

Figure 3:
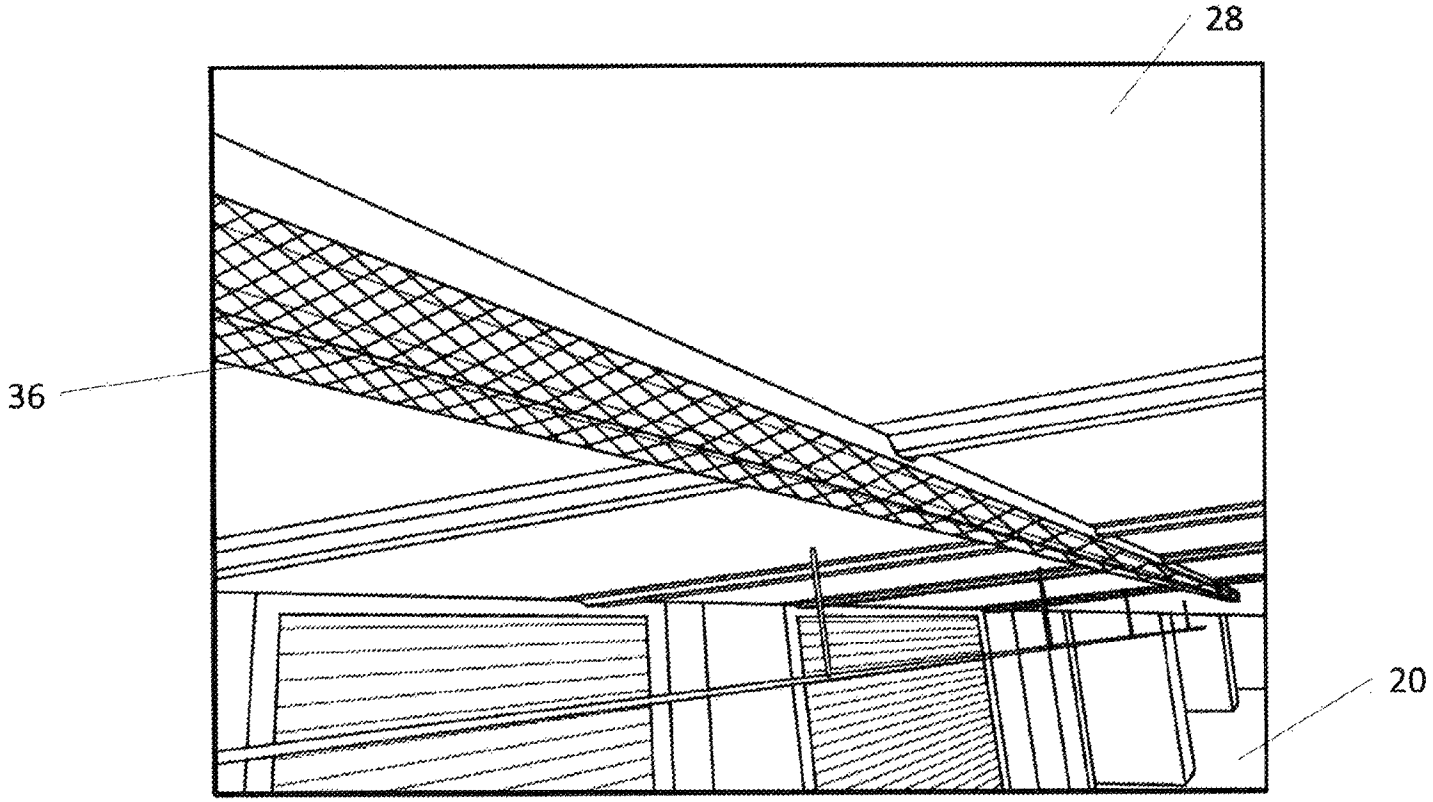
FIG. 3 is a partial perspective view of a protective housing of the cathodic protection system shown in FIG. 1 mounted inside a dryer.

In some embodiments, as shown in FIG. 3, anode 30 may be mounted to ceiling 28 of veneer dryer 20 inside a protective housing 36. Protective house 36 is air- and moisture-permeable. Protective housing 36 may comprise one or more of steel, mild steel, stainless steel, and aluminum, preferably mild steel.

Figure 4:
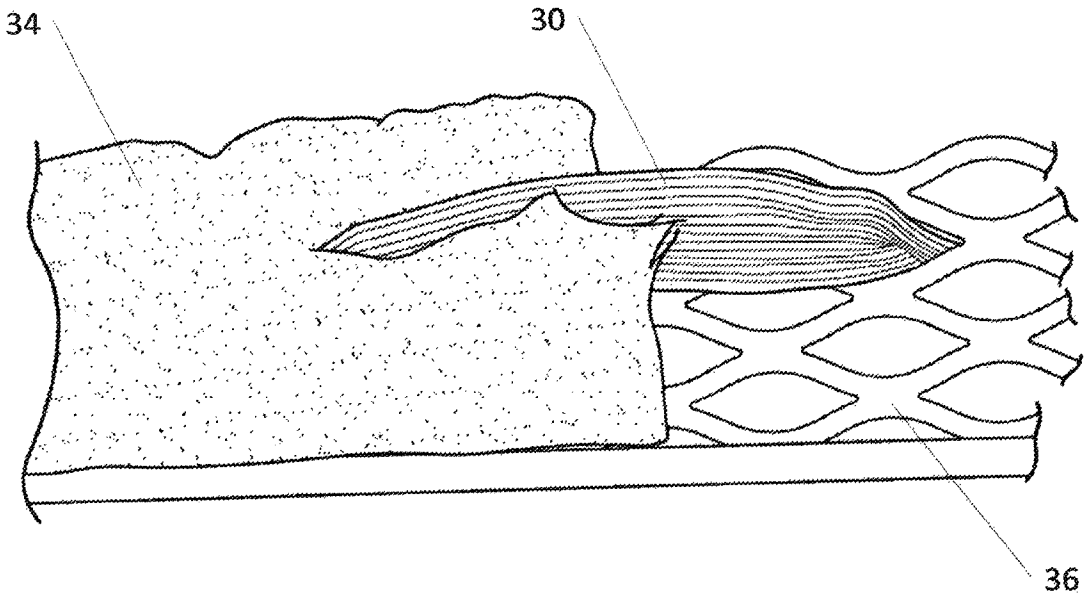
FIG. 4 is a partial perspective view of an anode of the cathodic protection system shown in FIG. 1.

In some embodiments, as shown in FIG. 4, anode 30 may be wrapped in an air-permeable membrane 34. As wood veneer is dried and a high-humidity atmosphere is produced inside veneer dryer 20, membrane 34 may become saturated with moisture and/or inorganic and/or organic compounds, whereby saturated membrane 34 may serve as an electrolytic medium inside veneer dryer 20. In some embodiments, membrane 34 comprises mineral wool, glass fibers, ceramics, clays, or a combination thereof, preferably mineral wool. Persons skilled in the art will recognize that membrane 34 may comprise any suitably porous material capable of withstanding the high temperatures employed inside veneer dryer 20 and capable of producing an electrolytic medium when saturated by a high-humidity atmosphere.

In operation, DC power supply 40 supplies a controlled amount of current to electrolytically couple anode 30 and the metallic structures and/or surfaces inside veneer dryer 20 when an electrolytic medium is present inside veneer dryer 20. The metallic structures and/or surfaces are thereby rendered the cathode of cathodic protection system 10 and protected from corrosion. For example, DC power supply 40 may use low voltage DC current to shift the potential of the metallic structures and/or surfaces inside veneer dryer 20 within the range of about (−) 0.700 V vs. silver/silver chloride (Ag/AgCl) to about (−) 1.200 V vs. silver/silver chloride (Ag/AgCl), preferably about (−) 0.800 V vs. silver/silver chloride (Ag/AgCl) or about (−) 0.950 V vs. silver/silver chloride (Ag/AgCl). Persons skilled in the art will recognize that the amount of current supplied by DC power supply 40 is readily ascertainable based on pH, temperature, the concentration of the electrolytic medium inside veneer dryer 20, and/or the conductivity of the electrolytic medium inside veneer dryer 20.

A computer system (not shown) may be used to monitor the conditions (such as temperature, pH, the concentration of the electrolytic medium, and/or the conductivity of the electrolytic medium) inside veneer dryer 20 and the current supplied by DC power supply 40 may be adjusted based on the detected conditions. The computer system thereby maintains an optimum current output over the life of anode 30. In the event that cathodic protection system 10 fails to operate, the computer system may be used to notify a user.

INTERPRETATION OF TERMS

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a substrate, assembly, device, manifold, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments described herein.

Specific examples of systems, methods, and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

We claim:

1. A cathodic protection system for use with a wood veneer dryer, the cathodic protection system comprising:

the wood veneer dryer;

an anode mounted inside the wood veneer dryer in a position to be electrolytically coupled to metallic structures or surfaces inside the veneer dryer when an electrolytic medium is present inside the veneer dryer; and a DC power supply having a positive pole electrically connected to the anode and a negative pole electrically connected to the metallic structures or surfaces, wherein:

the anode is comprised of or coated with one or more of high silicon iron, graphite, mixed metal oxides, platinum, niobium, tantalum, ruthenium, ruthenium oxide, rhodium, and rhodium oxide, and the anode is wrapped in an air-permeable membrane capable of producing the electrolytic medium when saturated by a high-humidity atmosphere inside the dryer.

2. The cathodic protection system according to claim 1, wherein the anode comprises niobium.

3. The cathodic protection system according to claim 2, wherein the anode comprises a niobium ribbon.

4. The cathodic protection system according to claim 1, wherein the air-permeable membrane comprises one or more of a mineral wool, glass fibers, ceramics, and clays.

5. The cathodic protection system according to claim 4, wherein the air-permeable membrane comprises mineral wool.

6. The cathodic protection system according to claim 1, wherein the anode extends from an input end to an output end of the veneer dryer inside a drying chamber.

7. The cathodic protection system according to claim 1, further comprising a computer system to monitor the conditions inside the veneer dryer and adjust the amount of current supplied by the DC power supply based on the detected conditions.

8. The cathodic protection system according to claim 1, wherein the DC power supply supplies an amount of current to the anode and metallic structures or surfaces inside the veneer dryer to shift the potential of the metallic structures or surfaces within the range of about (−) 0.700 V vs. silver/silver chloride (Ag/AgCl) to about (−) 1.200 V vs. silver/silver chloride (Ag/AgCl).

9. The cathodic protection system according to claim 8, wherein the DC power supply supplies an amount of current to the anode and metallic structures or surfaces inside the veneer dryer to shift the potential of the metallic structures or surfaces to about (−) 0.800 V vs. silver/silver chloride.

10. The cathodic protection system according to claim 8, wherein the DC power supply supplies an amount of current to the anode and metallic structures or surfaces inside the veneer dryer to shift the potential of the metallic structures or surfaces to about (−) 0.950 V vs. silver/silver chloride.

11. The cathodic protection system according to claim 1, wherein the DC power supply supplies an amount of current to the anode and metallic structures or surfaces inside the veneer dryer based on one or more of pH, temperature, electrolytic medium concentration, and electrolytic medium conductivity.

12. The cathodic protection system according to claim 1, wherein the anode is mounted in a protective housing inside the veneer dryer.

13. A method for reducing the corrosion of metallic structures or surfaces inside a wood veneer dryer, the method comprising:

mounting an anode inside the wood veneer dryer in a position to be electrolytically coupled to the metallic structures or surfaces inside the veneer dryer when an electrolytic medium is present inside the veneer dryer, wherein the anode is comprised of or coated with one or more of high silicon iron, graphite, mixed metal oxides, platinum, niobium, tantalum, ruthenium, ruthenium oxide, rhodium, and rhodium oxide;

electrically connecting a positive pole of a DC power supply to the anode and electrically connecting a negative pole of the DC power supply to the metallic structures or surfaces;

conveying wood veneer through the veneer dryer and heating the wood veneer inside the veneer dryer to a temperature sufficient to produce a high-humidity atmosphere inside the veneer dryer; and supplying a controlled amount of current to electrolytically couple the anode to the metallic structures or surfaces, wherein the anode is wrapped in an air-permeable membrane capable of producing the electrolytic medium when saturated by the high-humidity atmosphere inside the dryer.

14. The method according to claim 13, further comprising monitoring the conditions inside the veneer dryer and adjusting the amount of current supplied by the DC power supply based on the detected conditions.

15. The method according to claim 13, wherein the amount of current supplied shifts the potential of the metallic structures or surfaces within the range of about (–) 0.700 V vs. silver/silver chloride (Ag/AgCl) to about (–) 1.200 V vs. silver/silver chloride (Ag/AgCl).

16. The method according to claim 15, wherein the amount of current supplied shifts the potential of the metallic structures or surfaces to about (–) 0.800 V vs. silver/silver chloride.

17. The method according to claim 15, wherein the amount of current supplied shifts the potential of the metallic structures or surfaces to about (–) 0.950 V vs. silver/silver chloride.

18. The method according to claim 13, wherein the amount of current supplied is ascertainable based on one or more of pH, temperature, electrolytic medium concentration, and electrolytic medium conductivity.

19. The method according to claim 13, wherein the air-permeable membrane comprises one or more of a mineral wool, glass fibers, ceramics, and clays.

20. The method according to claim 19, wherein the air-permeable membrane comprises mineral wool.

21. The method according to claim 13, wherein the anode comprises niobium.

22. The method according to claim 21, wherein the anode comprises a niobium ribbon.

23. The method according to claim 13, wherein the anode extends from an input end of the veneer dryer to an output end of a drying chamber of the veneer dryer.

24. The method according to claim 13, wherein the anode is mounted in a protective housing inside the veneer dryer.

* * * * *